313-414 SR
11/23/82 XR 4,360,760

United States Patent [19]
Brodowski

[11] 4,360,760
[45] Nov. 23, 1982

[54] ELECTROSTATIC QUADRUPOLE ARRAY FOR FOCUSING PARALLEL BEAMS OF CHARGED PARTICLES

[75] Inventor: John Brodowski, Smithtown, N.Y.

[73] Assignee: The United States of America as represented by the United States Department of Energy, Washington, D.C.

[21] Appl. No.: 179,918

[22] Filed: Aug. 20, 1980

[51] Int. Cl.[3] ..... H01J 25/10
[52] U.S. Cl. ..... 315/5.41; 250/396 R; 313/361.1; 313/414; 315/3; 328/233
[58] Field of Search ..... 315/5.41, 5.42, 5.35, 315/3; 330/4.6, 4.7; 328/233; 250/396 R; 313/414, 361.1

[56] References Cited

U.S. PATENT DOCUMENTS

| | | | |
|---|---|---|---|
| 3,131,359 | 4/1964 | Adler et al. | 330/4.7 |
| 3,227,959 | 1/1966 | Kluver | 330/4.7 |
| 3,252,104 | 5/1966 | Gordon | 330/4.7 |
| 3,304,461 | 2/1967 | Prine | 330/4.7 |

*Primary Examiner*—Saxfield Chatmon, Jr.

[57] ABSTRACT

An array of electrostatic quadrupoles, capable of providing strong electrostatic focusing simultaneously on multiple beams, is easily fabricated from a single array element comprising a support rod and multiple electrodes spaced at intervals along the rod. The rods are secured to four terminals which are isolated by only four insulators. This structure requires bias voltage to be supplied to only two terminals and eliminates the need for individual electrode bias and insulators, as well as increases life by eliminating beam plating of insulators.

3 Claims, 4 Drawing Figures

ELECTROSTATIC QUADRUPOLE ARRAY FOR FOCUSING PARALLEL BEAMS OF CHARGED PARTICLES

BACKGROUND OF THE INVENTION

The United States Government has rights in this invention pursuant to Contract Number DE-AC02-76CH00016, between the United States Department of Energy and Associated Universities, Inc.

This application is related to and incorporates by reference, commonly assigned, co-pending application Ser. No. 152,461, entitled, "Means and Method for the Focusing and Acceleration of Parallel Beams of Charged Particles".

FIELD

This invention relates to apparatus for focusing beams of charged particles and more particularly to an array of electrostatic quadrupoles for focusing a plurality of parallel beams of charged particles.

PRIOR ART

Linear accelerators, or Linacs, are devices which use radio frequency energy to accelerate charged particles. In such devices, charged particles from a source are passed through a series of drift tubes which are separated from one another by gaps. A potential difference across the gaps, supplied by the radio frequency energy, is used to accelerate the particles.

Prior art means have been used to generate focusing forces on the particle beam in Linacs so as to counteract the tendency to diverge. Such means might be either electrostatic or electromagnetic, but typically were electromagnetic.

To focus a plurality of small beams or "beamlets", a device referred to as an electrostatic quadrupole has been used. An electrostatic quadrupole is an assembly of our electrodes which typically are positioned with their centers on the circumference of a circle and separated by 90 degrees, each of the electrodes being connected to a DC potential, the polarity of that potential being the same for opposite electrodes and opposite for adjacent electrodes.

A prior art quadrupole is illustrated in FIG. 1. In this Figure, vertical electrodes 14*v* and horizontal electrodes 14*h* are connected to insulators at each end, such as insulators 1 shown on the upper most electrode 14*v*. These insulators are connected to vertical plates 12, which contain ports 2. The vertical electrodes are connected to bias supply lead 16, while the horizontal electrodes are connected to bias supply lead 18. The insulators serve to electrically isolate the electrodes from the plates.

In the operation of this device, a particle beam is passed through the ports 2. The electrodes, which are symmetrically positioned about the ports, apply an electrostatic focusing field on the beam. The vertical electrodes may be supplied with a positive potential, for example, while the horizontal electrodes are supplied with a negative potential. As a beam of positive particles passes through the ports 2 and thus, through the center of the space between the electrodes, the positively biased vertical electrodes exert a strong force against divergence on any particle displaced from the beam in the vertical direction. The reverse is true for particles displaced from the beam in the horizontal direction because of the negative potential on the horizontal electrodes; however, the beam will pass through a series of quadrupoles in a Linac. The polarity of the bias on the electrodes is reversed in successive quadrupoles so that any dispersion occurring in one direction in one quadrupole is corrected on the next.

The quadrupole of FIG. 1 was developed by Alfred Maschke, the inventor in the patent application Ser. No. 152,461, incorporated herein by reference. This quadrupole, although operational, has a number of disadvantages. For example, each quadrupole requires eight insulators and the electrodes must be placed parallel to one another between the plates 12.

Each quadrupole is positioned about a separate set of ports to permit a beamlet to pass through its center. An array of 1,000 quadrupoles using configuration requires 8,000 insulators. Typically, each insulator and electrode would have to be individually fabricated, assembled, installed, and attached to a bias lead, a time consuming and costly process. The parallel alignment of so many electrodes about separate sets of ports between the two plates presents a difficult mechanical assembly problem. The location of the insulators close to the beam in this configuration subjects them to conductive plating, resulting in the eventual shorting of the electrodes to the plate.

Thus, it is an object of the present invention to provide quadrupole elements which do not require individual connections to a bias lead.

It is an object of the present invention to provide for the construction of arrays containing large numbers of quadrupole using only four insulators.

It is an object of the present invention to position the insulator remotely from the beamlets to avoid plating.

It is an object of the invention to provide a design for quadrupoles in which multiple electrodes and their accompanying support structure may be fabricated as a single element to substantially reduce assembly time.

SUMMARY OF THE INVENTION

In the present invention, a single quadrupole is formed of four identical elements. Each element comprises an electrode and a conductive support rod on which the electrode is mounted. The rod ends are terminated in four terminal blocks which are electrically isolated from each other by a total of only four insulators. No bias leads are required for this configuration as bias is supplied to the electrodes via the support rods.

The structure of a single quadrupole may be expanded to form a quadrupole array. To accomplish this, additional electrodes are mounted on the rods, and additional similar rods, each supporting multiple electrodes, are positioned within the frame formed by the four terminal blocks. No additional terminal blocks, insulators or bias leads are required regardless of the number of electrodes. The support rods and electrodes used in a large array may be identical, making it feasible to mass produce a single element consisting of multiple electrodes completely assembled on a support rod. This element may be produced by such methods as precision casting. It is thus possible to eliminate the individual assembly of the prior art insulators on each electrode and the need to align as many as a thousand or more electrodes between mounting plates.

DETAILED DESCRIPTION OF THE INVENTION

Figure 2B:
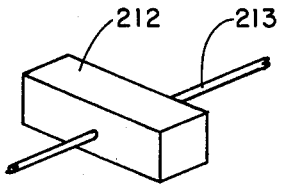
FIG. 2 is a perspective drawing of a quadrupole made in accordance with the present invention.
Figure 2A:
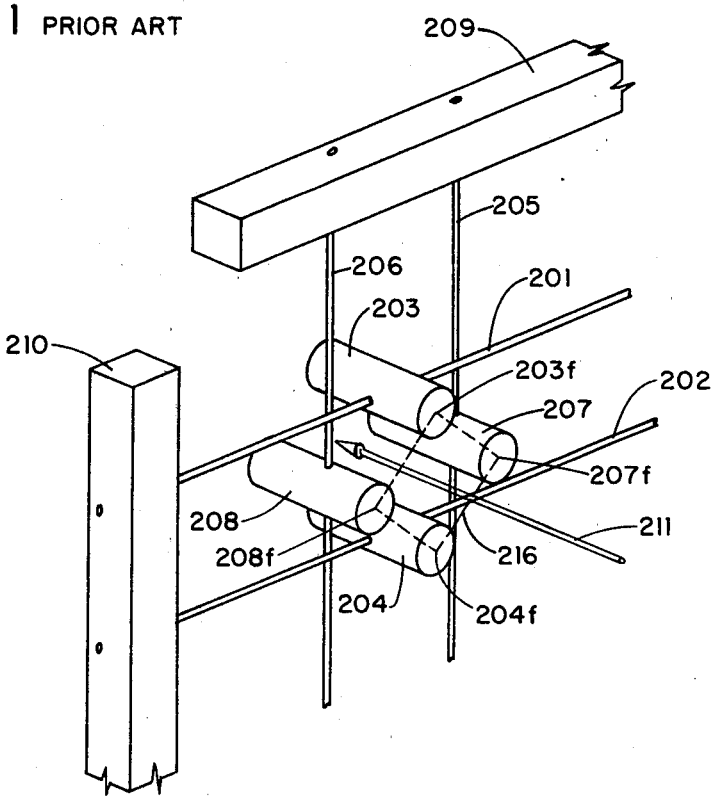

The device shown in FIG. 2A includes horizontal support rods 201 and 202 and vertical support rods 205 and 206. Mounted on these rods are electrodes, 203, 204, 207 and 208. The horizontal rods are electrically connected to, and mechanically supported by, terminal block 210, while the vertical rods 205 and 206 are similarly connected to and supported by terminal block 209. The four electrodes on these rods form the quadrupole.

In the operation of this quadrupole, a beam of particles, indicated by direction arrow 211, is passed through the center of the quadrupole. Bias voltage of opposite polarity is applied to the two terminal blocks. For example, a positive bias voltage may be applied to block 209 and negative bias voltage applied to block 210. Since the rods, blocks and electrodes are all conductive, the positive bias on block 210 will be conducted through rods 201 and 202 to electrodes 203 and 204. Similarly, the negative bias voltage applied to block 209 will be conducted through rods 205 and 206 to electrodes 207 and 208. A beam of positive particles passing through a quadrupole biased in this manner will have a strong focusing effect applied to it in the vertical direction by positively bias electrodes 203 and 204. Particles displaced from the center of the beam in the horizontal direction will not be focused in this quadrupole, but will be focused in the next quadrupole by means of reversing the bias on the electrodes.

The relationship and position of the various components in the quadrupole is important to its operation. It can be seen in FIG. 2 that the electrodes are symmetrical about their longitudinal axis. The longitudinal axes of the electrodes are parallel to the particle beam direction 211, and orthogonal to the longitudinal axes of the rods. The cross-sectional area of the electrodes is larger than that of the rods, and the electrodes are mounted on the rods symmetrically with respect to the cross-section of the electrodes, but asymmetrically with respect to their longitudinal axis.

The offset caused by this asymmetrical mounting is required to prevent the horizontal and vertical rods, which carry opposite bias voltages, from contacting each other. The projection of electrodes 203 and 204 due to the offset is greater towards the rear of the quadrupole, while the projection of electrodes 207 and 208 is greater towards the front of the quadrupole. The amount of offset for all the electrodes is identical, only the direction is reversed as necessary to avoid contact between the rods.

As a result of this arrangement, all the faces of the electrodes may be placed in a single plane to aid in providing a uniform focusing field on the beam. The faces of the electrodes, 203*f*, 204*f*, 207*f*, and 208*f*, all lie in a plane referred to herein as the array plane, which is orthogonal to the beam direction 211. The relative position of the electrodes in this plane also affects the field produced at the beam. It can be seen in FIG. 2 that if the centers of the electrode faces in the array plane are connected, they form a square 216, indicating a uniform, symmetrical positioning of the electrodes about the beam.

An element of a simple quadrupole is considered as including an electrode and its associated support rod. In the basic quadrupole of FIG. 2A, there are a set of two elements in which the support rods are mounted horizontally and a set of two elements in which the support rods are mounted vertically. The projections of all rods on the array plane form an angle of 45 degrees with respect to any side of the quadrupole square 216. One purpose of this positioning of the rods is to insure that the rods are maintained clear of the beam passage between the electrodes.

The above described relationships between the various components is typical, but not necessary to the operation of the invention. Other variations, which depart somewhat from the basis illustrative design presented in FIG. 2, are considered to be within the scope of the invention. For example, the electrodes may be other than the cylindrical form illustrated in FIG. 2A. FIG. 2B illustrates a bar-shaped electrode 212 on a support rod 213 where the electrode has a square rather than circular cross-section. Other electrode cross-sections are possible, but typically the electrodes will have a longitudinal axis which is positioned parallel to the beam to establish a focusing field for a significant distance along the beam path.

The 45° angle formed by the projection of the rods on the array plane and the square configuration of the electrodes are physical characteristics of the quadrupole which are designed to provide a uniform focusing field; however, some variation from this angle for the projection of rods and from the square configurations for the electrodes is possible without eliminating the usefullness of the focusing field.

Figure 3:
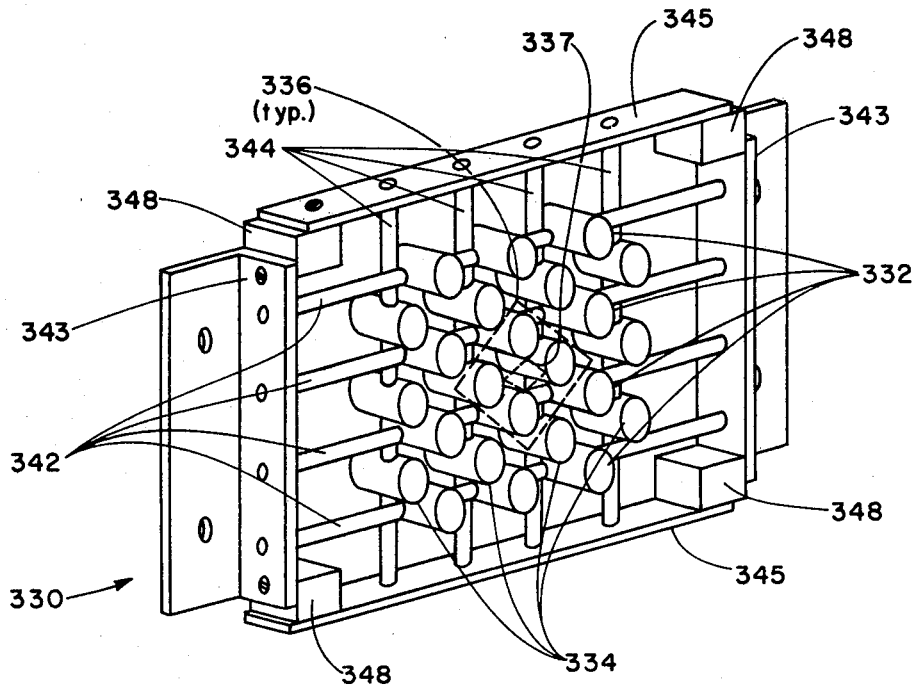
FIG. 3 is an array of quadrupoles made in accordance with the present invention.

The complexity of the quadrupole elements may be increased by adding additional electrodes to a support rod, and an array of similarly configured complex elements may be combined to form an array of quadrupoles which is capable of focusing multiple parallel beamlets. Such an array, indicated by drawing number 330, is illustrated in FIG. 3. This array comprises horizontal terminal blocks 345, vertical terminal blocks 343, insulators 348, horizontal support rods 342, vertical support rods 344, a plurality of electrodes mounted on the horizontal support rods 332, and a plurality of electrodes mounted on the vertical support rods 334.

The terminal blocks are positioned to form a rectangle with the blocks being secured at each corner to an insulator 348 to provide mechanical support as well as electrical isolation of the blocks. The horizontal rods are terminated at each end in a vertical terminal block while the vertical rods are terminated at each end in a horizontal block. The electrodes are offset on the rods and the rods are positioned to avoid contact in the manner described in the description of FIG. 2.

The twenty-four electrodes used in the device shown in FIG. 3 produces a total of seven quadrupoles, of which quadrupole 336 is typical. A square 336 formed by lines connecting the inner surfaces of the quadrupole in the array plane, when projected in the direction orthogonal to the array plane defines the area between the electrodes. The beam passes through the center of this area and accordingly, the portion of this area close to the beam must be free of rods or other obstructions.

In the operation of the array shown in FIG. 3, the vertical terminal blocks supply bias of one polarity via the horizontal rods to the vertical electrodes of all quadrupoles. Similarly, the horizontal blocks supply bias voltage of the opposite polarity via the vertical rods to the horizontal electrodes of all quadrupoles. Larger arrays may be made by simply increasing the number of rods and electrodes.

Figure 1:
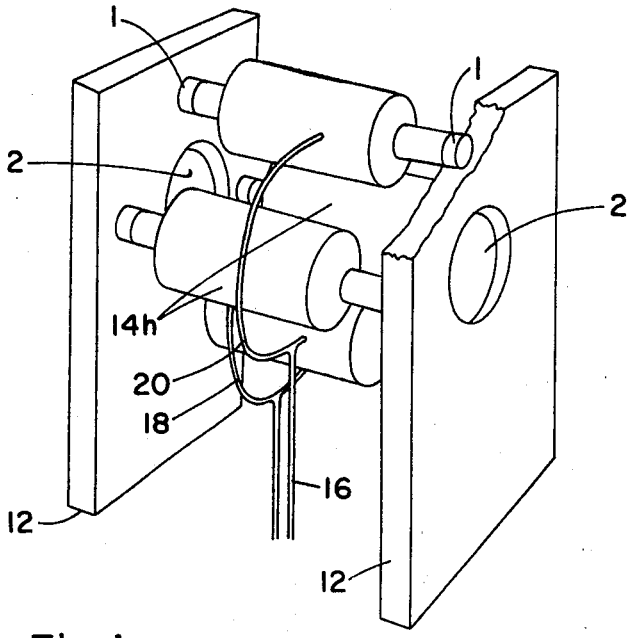
Fig. 1 PRIOR ART
FIG. 1 is a perspective drawing of a prior art quadrupole.

Elements formed of rods containing a plurality of electrodes can be made by a number of processes including precision investment casting. An array of such elements is assembled simply by anchoring the rods in the terminal blocks and securing the terminal blocks together through insulators. Using this procedure, a large array may be assembled quickly and easily. The need to handle many individual electrodes and insulators as well as to align each one between two plates, as was required with the prior art device shown in FIG. 1, is entirely eliminated. In the present invention there are only four insulators and these are far removed from the vicinity of any beam, reducing the possibility of shorting.

The present invention was disclosed in co-pending application Ser. No. 192,461, and it was noted therein that Mr. John Brodowski is the inventor of the quadrupole element and array described and claimed in the present invention.

What is claimed is:

1. An array of elements forming a quadrupole of the type which applies a strong focusing force to a beam of charged particles, comprising:

(a) four substantially identical elements, each comprising an electrically conductive support rod and an electrically conductive electrode, the electrode having a longitudinal axis and a cross-sectional area orthogonal to the longitudinal axis which is greater than the cross-sectional area of the rod, the electrode being mounted on and in electrical contact with the rod with the longitudinal axis of the electrode substantially orthogonal to the axis of the rod, the electrodes having planar faces at each end orthogonal to the longitudinal axis of the electrode, and the electrodes being mounted asymmetrically on the rods;

(b) means for positioning the electrodes in a substantially square array to form a quadrupole with the axes of the electrodes being substantially parallel, the faces of the electrodes being aligned in two planes orthogonal to the longitudinal axes of the electrodes, the rods connected to one pair of opposite electrodes forming a first parallel pair and the rods connected to the other pair of opposite electrodes forming a second parallel pair, the first pair of rods being substantially orthogonal to the second pair and spaced from the second pair due to asymmetrical mounting of the electrodes, the rods being so positioned that no rod will obstruct the passage of a beam through the volume, defined by the quadrupole, wherein the beam may be exposed to strong focusing forces and so that a plan view of the array taken orthogonally to the longitudinal axes of the electrodes would show the sides of the square formed by said electrodes being at an angle of approximately 45 degrees with the rods, the positioning means further comprising:

(b1) an insulator; and (b2) first and second conductive terminals, each terminal having two ends, the terminals being electrically and mechanically connected to the first and second pairs of rods respectively and being mechanically joined but electrically insulated at one end by the insulator, whereby the elements are held in position to form the quadrupoles and each of the pairs of opposite electrodes may be connected to sources of electrical potential so that they have opposite polarity.

2. An element array as claimed in claim 1, further comprising second, third, and fourth insulators, and third and fourth conductive terminals, each terminal having two ends and being mechanically joined at one end, but electrically isolated from each other by means of one of the insulators and said terminals being joined similarly at their other end to the free ends of the first and second terminals by the remaining insulators, the third terminal being positioned generally opposite the first terminal to receive the opposite end of the rods connected to the first terminal, and the fourth terminal being positioned opposite the second terminal to receive the opposite ends of the rods connected to the second terminal.

3. An element array as claimed in claim 2, wherein each of the elements further comprise a plurality of substantially identical electrodes similarly oriented and mounted on the rods, and the array further comprises a plurality of identical elements, the plurality of elements being divided into a first and a second group, the first group being positioned with their rods in the same plane as and connected to the same terminals as the first pair of rods, while the rods of the second group are positioned in the same plane as and connected to the same terminals as the second pair of rods, the plurality of electrodes on each rod being spaced along the rods and the rods being spaced along the terminals to form a plurality of quadrupoles each having a square array with the faces of the electrodes lying in the first and second planes.

* * * * *